US005873172A

United States Patent [19]

Siemel

[11] Patent Number: 5,873,172

[45] Date of Patent: Feb. 23, 1999

[54] CANT ANGLE MEASUREMENT DEVICE

[75] Inventor: Carlton Siemel, Aspen, Colo.

[73] Assignee: Surefoot LLC, Park City, Utah

[21] Appl. No.: 893,226

[22] Filed: Jul. 15, 1997

Related U.S. Application Data

[60] Provisional application No. 60/039,745 Mar. 3, 1997.

[51] Int. Cl.[6] ..... A61B 5/103; A43D 1/00

[52] U.S. Cl. ..... 33/512; 33/365

[58] Field of Search ..... 33/3 A, 3 B, 365, 33/366, 511, 512, 515; 128/782

[56] References Cited

U.S. PATENT DOCUMENTS

| | | | |
|---|---|---|---|
| 2,822,613 | 2/1958 | Lundberg | 33/33 A |
| 3,514,119 | 5/1970 | Sutherland . | |
| 3,726,015 | 4/1973 | Neumann . | |
| 3,807,060 | 4/1974 | Hanson et al. . | |
| 3,817,543 | 6/1974 | Haff . | |
| 3,885,329 | 5/1975 | French . | |
| 3,917,298 | 11/1975 | Haff . | |
| 4,074,446 | 2/1978 | Eisenberg . | |
| 4,078,322 | 3/1978 | Dalebout . | |
| 4,262,925 | 4/1981 | Plenk . | |
| 4,302,962 | 12/1981 | Williams | 33/365 |
| 4,351,120 | 9/1982 | Dalebout . | |
| 4,524,766 | 6/1985 | Petersen . | |
| 4,662,079 | 5/1987 | Graf et al. | 33/512 |
| 4,665,576 | 5/1987 | Limbach . | |
| 4,908,897 | 3/1990 | Sadlak . | |
| 4,945,659 | 8/1990 | De Marchi et al. . | |
| 4,961,591 | 10/1990 | Bejean et al. . | |
| 5,070,623 | 12/1991 | Barnes . | |
| 5,121,753 | 6/1992 | Paez | 33/515 |
| 5,147,365 | 9/1992 | Whitlock et al. . | |
| 5,457,891 | 10/1995 | Taylor | 33/512 |

OTHER PUBLICATIONS

Witherell et al, "Ski Better Instantly . . . ", *Snow Country,* Oct. 1993, pp. 138–144.

*Primary Examiner*—G. Bradley Bennett
*Attorney, Agent, or Firm*—Michael de Angeli

[57] ABSTRACT

A method and apparatus are described for determining the amount of canting necessary to correct the ski boot-ski interface to compensate for inherent misalignment between a skier's lower leg and the bottom of the sole of his or her boots. The skier's foot is secured in the boot, and the boot is secured on a platform freely rotatable about a longitudinal centerline axis. A rod also freely rotatable about the same axis is centered with respect to the knee by a knee clamp attached to the rod. A pointer affixed to the rod is used to accurately determine the angle between the rod and platform on a scale extending from the boot platform. This angle is then used to guide the placement of shims or the employment of other means to effect the desired orientation of the knee, and consequently the lower leg, relative to the ski, for optimum control.

15 Claims, 3 Drawing Sheets

52
56
57
62
61
61
57
60
74
70
72
48
58
66
68
64
79
80
0
81
76
K
S
C
46
78
82
84
78
10
28
47
22
20A
47
A
20
8
24
49

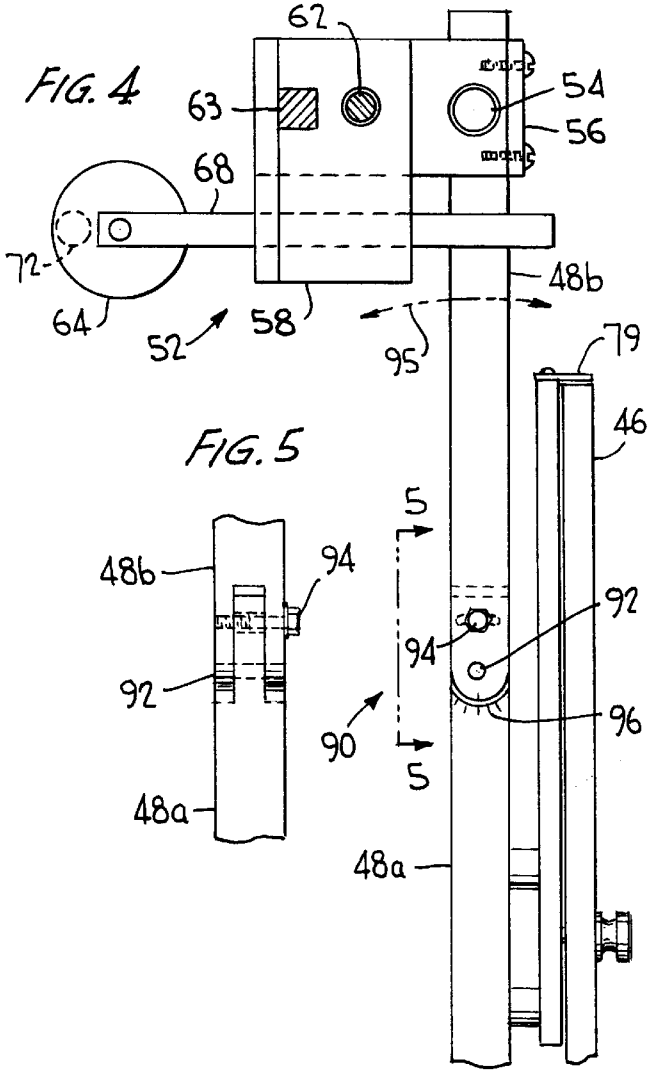
FIG. 4
FIG. 5
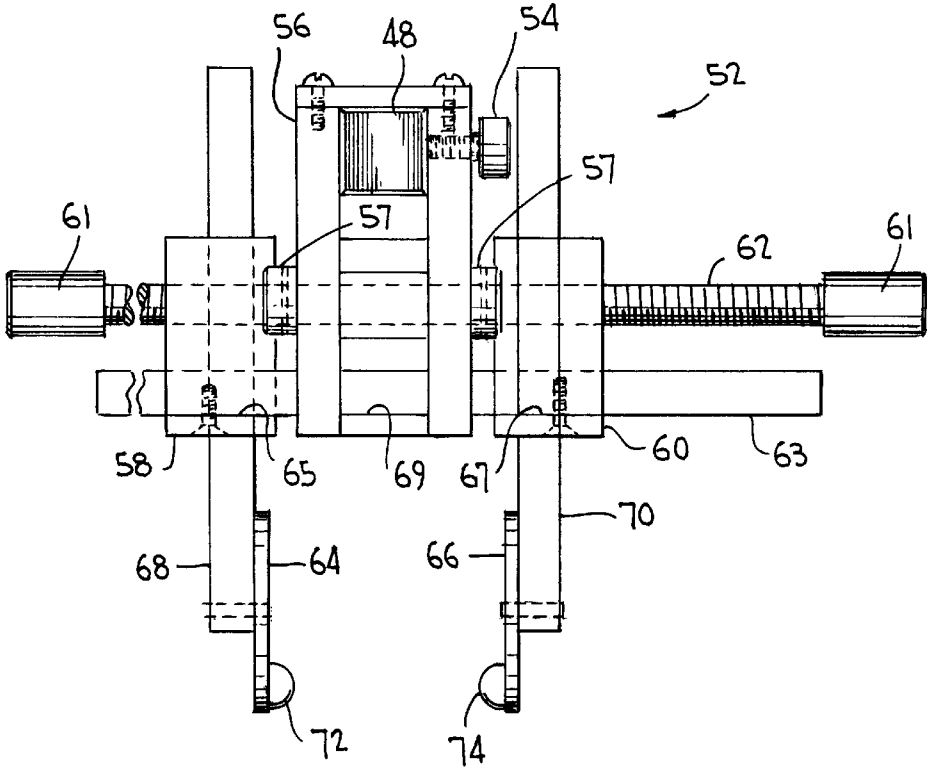
FIG. 3

CANT ANGLE MEASUREMENT DEVICE

CROSS-REFERENCE TO RELATED APPLICATION

This application claims priority from Provisional patent application Ser. No. 60/039,745, filed Mar. 3, 1997.

FIELD OF THE INVENTION

The present invention pertains generally to remediation of improper alignment between a skier's legs and skis, and more particularly to a method and apparatus for precisely measuring the cant angle between the sole of a skier's boot and his or her lower leg to facilitate proper corrective shimming or other adjustment of the boot-ski interface.

BACKGROUND OF THE INVENTION

In snow skiing, turns are initiated and sustained by applying pressure to the longitudinal edges of both skis. It is generally understood that turning is much easier if the skier has a slightly "knock-kneed" posture, with the skier's lower legs between about one and two degrees inside vertical when the skis are horizontal. In this position, somewhat more than half of the skier's weight is placed on the inside edges of the skis.

In general, the rigid state-of-the-art ski boots, and the ski bindings by which the boots are releasably secured to the skis, fix the angle of the skier's lower legs in the plane transverse to the direction of elongation of the skis with respect to the upper suface of the skis (hereinafter, the "cant angle"). The cant angle obtained varies substantially with respect to the inherent physiognomy of the individual skier and the design of the particular ski boot.

It is known that adjustment of the cant angle to obtain the preferred "inside-edge" weight distribution is desirable in order to provide optimum control and consequently skill and enjoyment. As noted, the optimal cant angle is only concidentally obtained when a skier selects a new pair of boots; accordingly, the art recognizes that the fit of ski boots with respect to the skis is preferably customized in order to obtain the ideal cant angle.

A number of methods exist for adjusting the the cant angle between the upper surface of the ski and the skier's lower leg. These include the placement of wedge-shaped or spaced asymmetrical shims under the ski bindings, employment of interchangeable boot soles providing various cant angles between the boots and ski bindings, modification of the boots, and adjustable cuffs incorporated into certain boot designs. However, unless the cant angle itself can be precisely determined, one must follow a time-consuming tedious trial and error approach to boot fitting using any of these techniques.

In the past, shimming requirements have been crudely estimated by dropping a plumb line from a vertical mark formed on the skier's knee to the front edge of the boot, followed by repetitively varying the thickness of shims placed between the boot and ski until the plumb line came within a prescribed distance from the boot centerline.

An apparatus for indicating the cant angle provided to a given skier wearing a particular pair of boots is disclosed in U.S. Pat. No. 3,726,015 to Neumann. The Neumann apparatus comprises an elongate flat base plate supported to allow tilting about the longitudinal axis and having a wand extending upward from the forward end of the base plate, perpendicular to the longitudinal axis. The wand is also pivoted about an axis perpendicular to the direction of elongation of the ski, allowing the skier to assume various degrees of knee bend. A knee clamp comprising opposed knee-engaging plates simultaneously drawn toward one another by rotation of a lead screw having oppositely-threaded portions may be provided to ensure centering of the wand on the skier's knee.

In use of the Neumann apparatus, the skier stands in skiing posture on the plate with the toe of the boot centered against the base of the wand. The misalignment between the skier's lower leg and the wand approximates the cant angle between the boot sole plane and the lower leg. Correction is then to be made on a trial-and-error basis, either by modifying the boot itself, or by adding various shims, until alignment of the wand and knee indicates that the desired alignment has been achieved. That is, Neumann provides no scale or other instrument whereby the amount of the appropriate correction to be made can be determined directly; accordingly, use of the Neumann device, involving repetitive steps of the skier's putting on the boot, having a measurement made, removing the boot, modifying the boot or shims, and repeating these steps, would be rather time-consuming and awkward.

Furthermore, while Neumann's provision of the knee clamp having opposed, cooperatively-moved knee-engaging plates does provide a degree of accuracy in locating the center of the knee, as this clamp is fixed to the wand the skier will tend to distort his or her natural posture in order to fit the knee into the clamp.

An instrument providing a direct measurement of the skier's "natural" cant angle would be much more useful in provision of the appropriate correction. In a field where the skier's performance and enjoyment of the sport is directly impacted by variations in cant angle of as little as one-half degree, the imprecision of this and other prior art approaches to cant angle measurement and correction fails to meet the needs of modern competitive and recreational skiers.

OBJECTS OF THE INVENTION

It is therefore an object of the present invention to provide an apparatus and method for accurately and conveniently measuring the "natural" cant angle obtained by a given skier wearing a particular ski boot.

It is a further and related object of the present invention to provide an apparatus and method for accurately and conveniently determining the amount of cant angle correction required, and thereby to allow immediate selection of the shim, or degree of modification of the boot, required in order to obtain the desired cant angle.

A further object of the invention is to provide improved methods and apparatus for fitting skiers to their ski boots.

SUMMARY OF THE INVENTION

According to the present invention, the skier's foot is secured in the desired boot. The boot is secured on a planar base member freely rotatable about a longitudinal centerline axis by a securing device replicating the securing of the boot to a ski by conventional ski bindings. A knee clamp rod also freely rotatable about the same axis is centered with respect to the knee by a centering knee clamp slidably attached to the rod, and is thus parallel to the skier's lower leg. The rod may be pivoted in the fore-and-aft plane to allow the skier to assume various skiing postures. An indicator bar extends perpendicular to the plane of the upper surface of the boot platform. The angle between the rod and bar thus replicates the cant angle of the skier's lower leg with respect to the upper surface of the ski. The cant angle can be conveniently read by comparing a mark on the indicator rod to a scale affixed to the knee clamp rod, and used to guide the selection of and placement of shims or other means to effect the desired orientation of the knee, and consequently the lower leg, relative to the ski, for optimum control.

BRIEF DESCRIPTION OF THE DRAWINGS

The invention will be better understood if reference is made to the accompanying drawings, in which:

FIG. 3 is a top view in partial cross-section of the knee clamp assembly of the device of FIGS. 1 and 2;

FIG. 4 is a side view in partial cross-section of a modified embodiment of the present invention; and FIG. 5 is a front view in partial cross-section taken through line 5—5 of the modified embodiment of the invention shown in FIG. 4.

DESCRIPTION OF THE PREFERRED EMBODIMENTS

Figures 1, 1A:
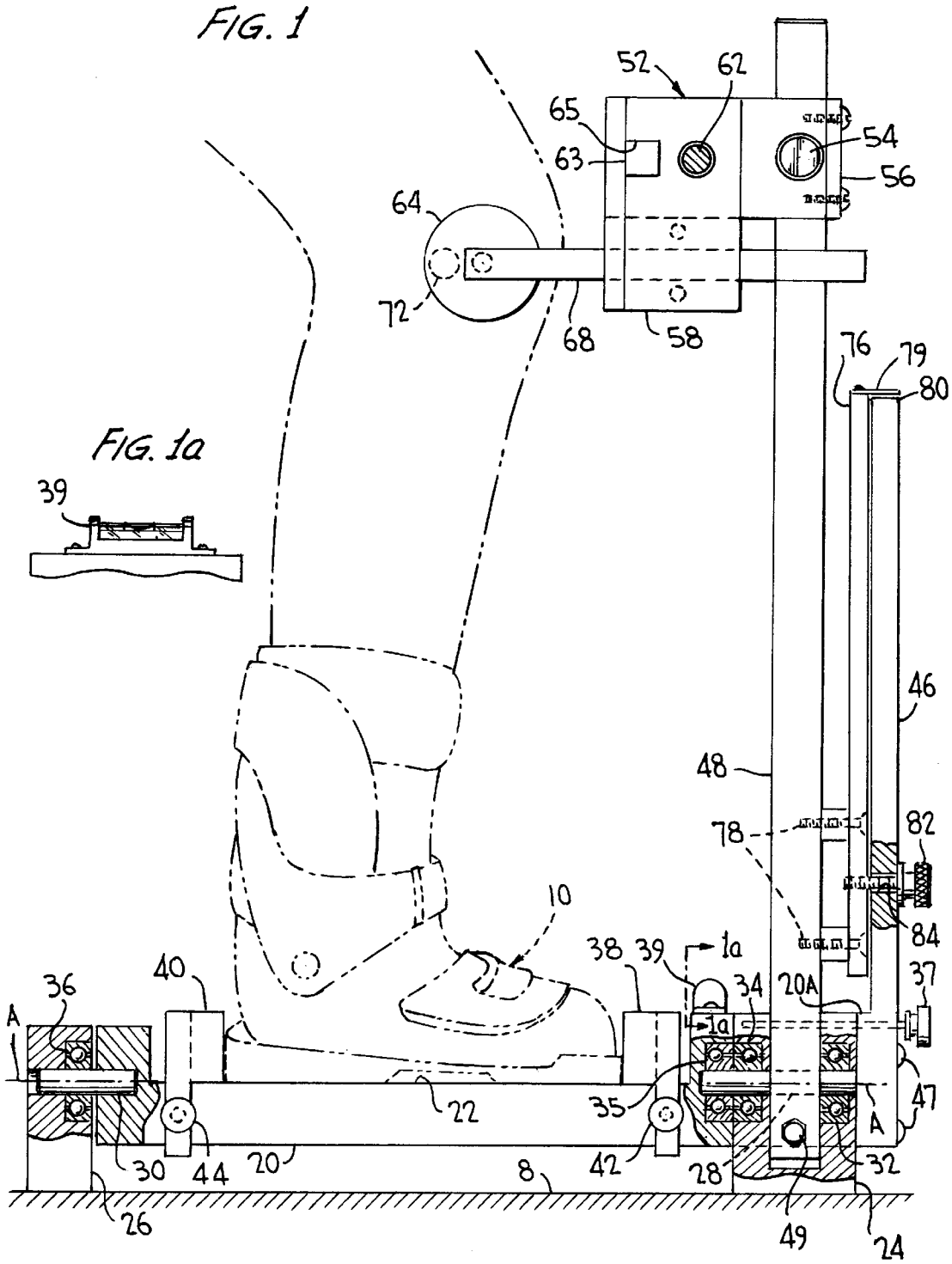
FIG. 1 is a side elevation view in partial cross-section of a cant angle measurement device according to the present invention, showing a skier's lower leg and ski boot in dot-dash lines.
FIG. 1A is a partial rear view taken along line 1A—1A of FIG. 1.
Figure 2:
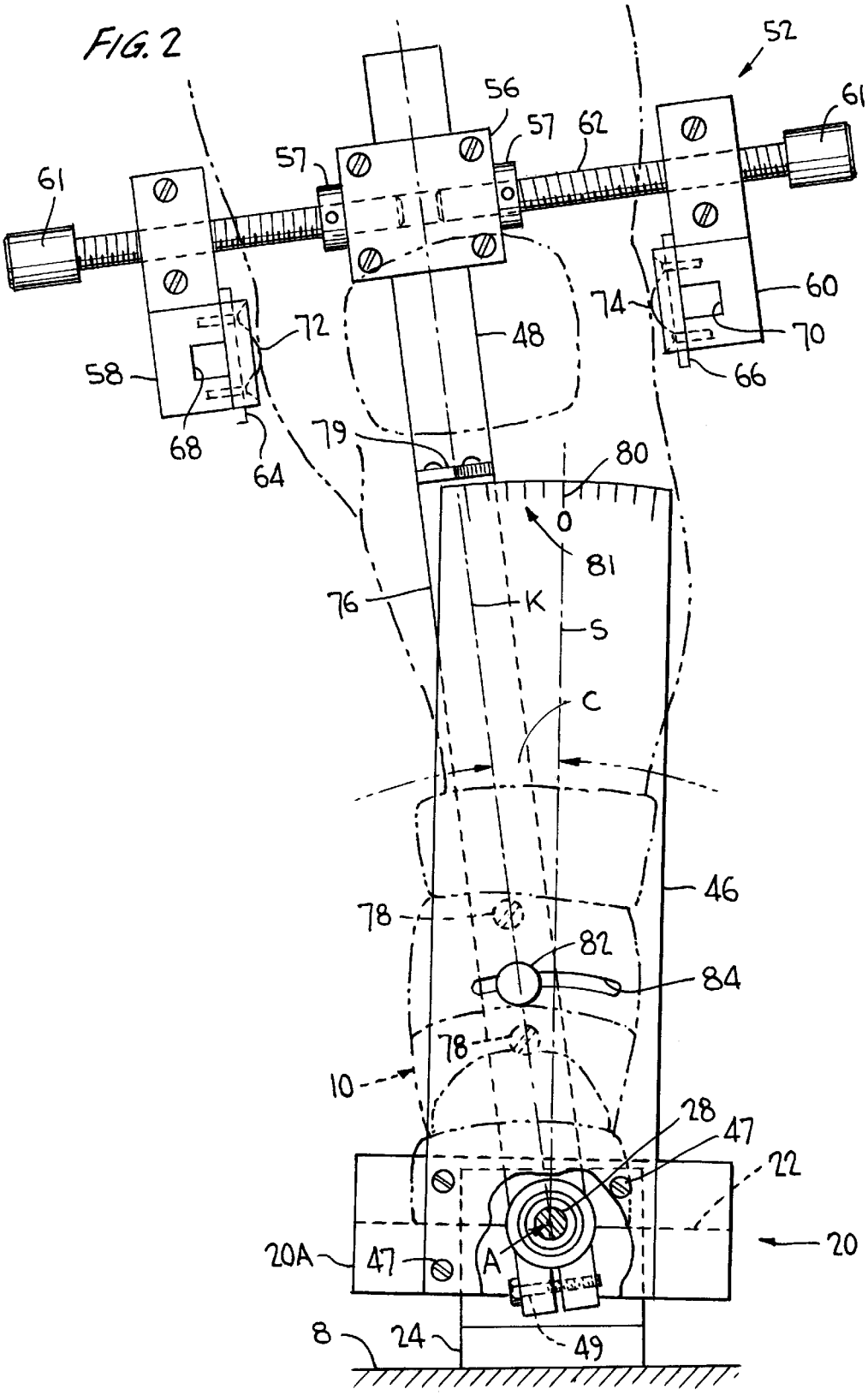
FIG. 2 is a front view in partial cross-section of the cant angle measurement device of FIG. 1, showing a skier's lower leg and ski boot in dot-dash lines, and illustrating the cant angle.

A device according to a first embodiment of the present invention for precisely measuring the cant angle formed between the sole of a skier's boot and the axis of his lower leg is shown in FIGS. 1, 2, and 3.

An elongate base member 20 defining a flat upper surface 22 is supported on colinear pivot pins 28 and 30 extending rotatably through bearings 32, 34, and 36 fitting within bores in forward and rearward base blocks 24 and 26, respectively. More specifically, rear pin 30 may be fixed with respect to base member 20; however, in the preferred embodiment depicted, forward pin 28 is supported by bearing 35 for free rotation with respect to base member 20, for reasons made clear below. Base member 20 is thus freely rotatable about a longitudinal axis A; axis A lies in upper surface 22 of base member 20. Boot centering blocks 38 and 40 are slidably attached to base member 20 to receive and secure a ski boot 10 to upper surface 22; blocks 38 and 40 fit the boot 10 as do ski bindings, such that the boot 10 bears the same relation to surface 22 during the measurement process according to the invention as it will to a ski during skiing. Blocks 38 and 40 are secured in place along base member 20 by set screws 42 and 44.

Base member 20 comprises a box-like extension 20A extending around forward base block 24. An upwardly extending indicator bar 46 is fixed by screws 47 to extension 20A of base member 20, so as to rotate therewith. An indicator scale 81 is provided on the forward face of bar 46, located such that the central zero point 80 lies on the centerline S of indicator bar 46, extending through the axis A about which base member 20 rotates; zero point 80 thus lies in a plane perpendicular to the plane of the upper surface 22 of the base member 20 (and effectively thus perpendicular to the upper surface of a ski in use) and including longitudinal axis of rotation A.

An upwardly extending knee clamp rod 48 is clamped to forward pivot pin 28 by pinch bolt 49. As mentioned above, forward pivot pin 28 is freely rotatable with respect to both base member 20 and base block 24. Knee clamp rod 48 is therefore rotatable around the same axis A as base member 20, but independently thereof.

A knee clamp assembly 52 comprising an assembly case 56 supporting a pair of relatively movable knee-contacting anvils 64 and 66 is slidably mounted along the upper portion of knee clamp rod 48. Knee clamp assembly is secured at a desired vertical position along the rod 48 (i.e., corresponding to the length of the skier's lower leg) by a set screw 54 threaded into assembly case 56. Anvils 64, 66 are carried by support blocks 58 and 60 on opposite sides of assembly case 56. The positions of support blocks 58 and 60 on either side of assembly case 56 are simultaneously adjusted by rotation of an adjusting screw 62. Screw 62 is located laterally with respect to assembly case 56 by clamping collars 57 on either side thereof, and has oppositely-handed male threads on its opposed ends to interact with corresponding female threads formed in the blocks 58 and 60. Blocks 58 and 60 are thus constrained to move simultaneously in opposite directions along adjusting screw 62 upon its rotation; rotation of block 58, 60 around screw 62 is precluded by a square bar 63 sliding within corresponding apertures 65 and 67 on blocks 58 and 60, and within a similar aperture 69 in mounting case 56.

To provide further flexibility in fitting skiers, knee-contacting anvils 64 and 66 are mounted on support bars 68 and 70 slidably mounted on support blocks 58 and 60, allowing adjustment of the spacing of anvils 64, 66 from clamp support rod 48. For similar reasons, knee-contacting anvils 64 and 66 may be formed as independently-rotatable discs including inwardly extending positioning pads 72 and 74.

Accordingly, when adjusting screw 62 is rotated by a user applying hand torque to gripping sleeves 61, blocks 58 and 60 are simultaneously drawn together or spread apart, depending on the direction of rotation of screw 62, while remaining equidistant with respect to the centerline K of knee clamp rod 48. In use, a skier's knee is disposed between anvils 64, 66 (see FIG. 2), and the anvils located at the height of the skier's knee joint line, at which the tibia and femur abut. Screw 62 is rotated until the anvils contact the skier's knee on opposed sides thereof. As the anvils move simultaneously inwardly with respect to knee clamp support rod 48, rod 48 is thereby precisely centered with respect to the knee. More particularly, the adjustment screw cooperates with the anvil mounting structure so that the anvils are maintained equidistant from a centerline K of the knee clamp rod, while permitting their simultaneous movement toward and away from one another along a line in a plane perpendicular to the axis of rotation A of base member 20. The knee clamp is thus centered with respect to the knee joint line.

It will be appreciated that the centering of the knee clamp rod with respect to the outer surfaces of the knee, as above, amounts to an essentially arbitrary determination of a point of reference. However, the point on the skier's lower leg thus located is sufficiently well-defined to allow meaningful comparison of results obtained with respect to various skiers, and, for example, allows a skier to obtain consistent "feel" when purchasing a new pair of boots.

As noted, the knee clamp rod 48 is thus centered with respect to the skier's knee in a plane including the axis of rotation A of the sole of the boot; all that remains to determine the cant angle is to measure the angle between rod 48 and upper surface 22 of base member 20.

As mentioned above, the sole of the skier's boot is perpendicular to the centerline S of indicator bar 46 (see FIG. 2), while the centerline K of knee clamp rod 48 is centered with respect to the skier's knee. As illustrated in FIG. 2, the cant angle C is therefore the angle between centerlines S and K.

To simplify and render more reliable the measurement of the cant angle C, a rigid arm 76 attached by bolts 78 to knee clamp rod 48 extends parallel thereto. Arm 76 carries a forwardly extending pointer 79 juxtaposed to scale 81 provided on the upper portion of indicator bar 46. A fitting technician can then directly and accurately determine the "natural" cant angle C between a plane perpendicular to the upper surface of base member 20, as represented by the centerline S of indicator bar 46, and the center of the skier's knee, as represented by the centerline K of knee clamp rod 48.

A lock bolt 82 threaded into a bore in arm 76 extends through an arcuate slot 84 in indicator bar 46. Lock bolt 82 can be tightened to secure arm 76 in position relative to the indicator bar, simplifying measurement of the cant angle C.

Preferably, the relative position of blocks 58 and 60 with respect to the centerline of knee clamp rod 48 is adjusted to calibrate the device, e.g., upon initial manufacture. Calibration is accomplished by clamping a rectangular test member in lieu of the skier's boot and lower leg and adjusting the lateral positions of blocks 58 and 60 until both anvils touch the test member and the angle between a plane perpendicular to the upper surface 22 of base member 20 and knee clamp rod 48, as measured on indicator scale 81, is exactly 0°.

The method for determining the appropriate shimming for a ski boot according to the invention thus comprises the steps of having the skier center his or her foot and boot laterally on the upper surface 22 of the base member, with the toe of the boot against the rear side of forward boot block 38. Rearward boot block 40 is positioned to clamp the boot from behind and is secured to the base by tightening set screw 44. A flat block of the same height dimension as the spacing of the axis above the floor 8 (FIG. 2) is provided to support the skier's other foot in a matching boot; alternatively, two essentially identical devices can be provided, to measure the cant angles of both legs simultaneously. The skier then assumes a desired skiing posture with knees appropriately flexed and weight evenly distributed between the two feet. The base member rotates freely about axis A to assume the angular orientation corresponding to the natural angle defined between the bottom of the skier's boot and the vertical; in this way the measurement of the skier's natural cant angle (as mentioned, a function of the skier's physiognomy and the design of the boot) is not distorted by constraining the bottom of the boot to rest flat on the floor.

The freely rotatable knee clamp rod 48 is then aligned approximately with the axis of the skier's lower leg, and the knee clamp assembly 52 is positioned at the same level as the knee. Anvils 64 and 66 are adjusted forward and backward as needed by sliding support bars 68 and 70 so as to be aligned generally with the inner and outer centers of the knee. Fine adjustment of the positioning of the support pads 72 and 74 is achieved by rotating the knee side support discs on their support bars. The correct alignment of anvils is such that they contact the knee on opposite sides of the knee joint line, as mentioned above.

After final placement of the support pads in vertical and fore and aft alignment with respect to the knee joint side centers, adjusting screw 62 is turned to bring the pads 72 and 74 gently yet firmly into engagement with the opposed sides of the knee, so that the knee is centered with respect to rod 48 and thus arm 76. The cant angle C between the perpendicular to the bottom of the sole of the skier's boot and the axis of his lower leg is then read directly by comparison of the position of the pointer 79 extending from rigid arm 76 with respect to the calibrated scale 81 on indicator bar 46. This angle can be temporarily preserved by locking bolt 82. The skier can then remove his foot and boot from the apparatus, and the fitting technician can use the precisely indicated cant angle C to perform corrective shimming, or other modification of the relationship between the boot and ski, as indicated above.

The same apparatus can be used to determine the desired cant angles separately with respect to the skier's two legs, or two similar devices can be provided on a single base.

An optional feature, shown in FIG. 1, comprises a first lockpin 37 extending through mating passages in the forward base block 24 and the forward face 20A of base member 20 to lockably maintain the base member in a selected position relative to the base block 24, thus securing the relatively rotating components of the mechanism when the device is not in use.

It is found that if the base member 20 is not essentially horizontal during fitting, the skier may tend to alter his or her posture, distorting the measurement. Accordingly, a level 39, shown in FIGS. 1 and 1A, may also be mounted transversely atop the end of base member 20, to indicate any shimming or other compensation necessary to overcome the effects of uneven support surfaces 8.

In a further modification, illustrated in FIGS. 4 and 5, upwardly extending knee clamp rod 48 is divided into a lower portion 48*a* and an upper portion 48*b*, pivotally connected by a hinge assembly 90. Hinge assembly 90 includes a pivot pin 92 extending transversely through upper portion 48*b*, which is thereby free to rotate forward and rearward, as indicated by arrow 95, with respect to the lower portion 48*a*. This movement provides added flexibility of movement for the knee clamp assembly 52, allowing assembly 52 to remain positioned on the knee of a skier over a substantial longitudinal range of motion in a plane including the axis of rotation of the base member, e.g., allowing the knee clamp assembly 52 to move forwardly and rearwardly as the skier gradually flexes his or her knee. Any variation in the cant angle C measured during this motion may indicate the need for additional corrective measures. Hinge assembly 90 also includes a further lockpin 94 extending through an arcuate slot in clamp rod upper portion 48*b* to secure it in a fixed position with respect to lower portion 48*a*. Lockpin 94 can alternatively be configured as a pinch bolt, fixing the angle by compressing the hinge assembly about pin 92. Angular calibrations or markings 96 may be applied to the hinge pivot to facilitate record-keeping and reconfiguration.

From the foregoing description it will be appreciated that the present invention makes available an inexpensive, precise and easily operated measuring device to determine the "natural" cant angle between a skier's lower leg and the bottom of his ski boot; with the precise knowledge of this cant angle, it is a simple matter to provide appropriate shims between the boot and the ski bindings or modify the boot to correct the cant angle as needed to reach a desired value, providing maximum control and comfort to the skier.

Further modifications to the invention as disclosed specifically herein are similarly within its scope. The separate rigid arm 76 could be dispensed with in favor of a pointer mounted directly on the knee clamp rod 48. The pointer could be provided on the indicator bar 46, and the scale on the knee clamp rod 48. Numerous types of mechanism for ensuring that the knee is centered with respect to the knee clamp rod, as well as various devices for equivalently locating a measuring member with respect to a predetermined point on the skier's lower leg, are within the scope of the invention. Indeed, the cant angle C could be measured by comparison of a scale provided on a separate member bearing a known angular relationship to the knee clamp rod to a pointer on a member similarly bearing a predetermined relationship to the plane of the upper surface of the base member 20, on which the ski boot rests.

Therefore, the present invention should not be measured by the above exemplary disclosure, but only by the appended claims.

What is claimed is:

1. An angle measurement device for determining the cant angle formed between a skier's lower leg in a given ski boot and an upper surface of an associated ski, said device comprising:

a base member having a flat upper surface, and comprising means for securely receiving the bottom of a ski boot thereon, said base member being supported with respect to a support surface and journaled to freely rotate about an axis parallel to said flat upper surface and extending along the longitudinal centerline of said bottom of a ski boot;

an indicator member defining one or more reference indicia bearing a predetermined angular relationship to a plane perpendicular to said flat upper surface and including said axis;

an upwardly extending knee clamp rod independently rotatable about said axis;

a knee clamp assembly mounted along said knee clamp rod, said knee clamp assembly comprising means for securely engaging opposed sides of a skier's knee and to locate said knee with respect to said knee clamp rod; and means for measuring the angle formed between said indicator member and said knee clamp rod.

2. The device of claim 1 wherein said means for securely receiving the bottom of a ski boot on said base member comprises forward and rearward boot centering blocks securable along said base member to position and clamp said boot.

3. The device of claim 1 wherein said knee clamp assembly comprising means for securely engaging opposed sides of a skier's knee and to locate said knee with respect to said knee clamp rod comprises first and second knee-contacting anvils mounted to engage opposite lateral surfaces of said skier's knees, said anvils being mounted to said knee clamp rod by means maintaining both said anvils equidistant from a predetermined point fixed with respect to said knee clamp rod, while permitting simultaneous movement of said anvils toward and away from one another along a line in a plane perpendicular to said axis of rotation of said base member.

4. The device of claim 3 wherein said means maintaining both said anvils equidistant from a centerline of said knee clamp comprises an adjustment screw fixed laterally with respect to said knee clamp rod and having oppositely-handed threads on opposed ends thereof, to cooperate with corresponding oppositely-handed threads formed in support blocks with respect to which said anvils are fixed.

5. The device of claim 4 further comprising means for preventing rotation of said support blocks around said screw.

6. The device of claim 1 wherein said indicator member extends upwardly from said base member, and said means for measuring the angle formed between said indicator member and said knee clamp rod comprises a pointer fixed with respect to said knee clamp rod and juxtaposed to said reference indicia on said indicator member.

7. The device of claim 6 wherein said pointer is secured to a rigid arm extending parallel to said knee clamp rod.

8. The device of claim 1, further comprising a level indicator mounted transversely atop said base member.

9. The device of claim 1 wherein said knee clamp rod comprises upper and lower portions pivotally connected to one another by means permitting relative pivoting thereof in a plane including the axis of rotation of said base member.

10. An angle measurement device for determining the cant angle formed between a skier's lower leg in a ski boot and an upper surface of an associated ski, said device comprising:

a base member having a flat surface for receiving the bottom of a ski boot, said base member pivotally mounted to freely rotate about an axis along the longitudinal centerline of said boot bottom;

means for identifying a plane including a determined point on the skier's lower leg and said boot bottom centerline axis; and means for measuring the angle subtended between said flat surface of said base member and said plane.

11. The device of claim 10, wherein said means for identifying comprises an upwardly extending knee clamp assembly pivotally mounted to freely rotate about said boot bottom centerline axis.

12. The device of claim 11, wherein said means for measuring comprises a scale calibrated to indicate the angle formed between said flat surface and said knee clamp assembly.

13. A method for fitting a skier to a particular pair of ski boots, comprising the steps of:

providing a cant angle measuring device, comprising:

a base member having a flat surface for receiving the bottom of a ski boot, said base member pivotally mounted to freely rotate about an axis along the longitudinal centerline of said boot bottom;

means for identifying a plane including a determined point on the skier's lower leg and said boot bottom centerline axis; and means for measuring the cant angle subtended between said flat surface of said base member and said plane;

having the skier put on said boots;

securing a first one of said boots to said base member;

measuring a first cant angle between said plane and the centerline of said first one of said boots;

determining the amount of modification of the fit of said first one of said boots to modify said measured cant angle to reach a preferred cant angle;

repeating said steps of securing, measuring, and determining with respect to the second of said boots; and modifying the fit of said boots with respect to respective skis accordingly.

14. The method of claim 13, wherein said step of determining a plane is performed with respect to the centers of the skier's knees by operation of a knee clamp, said knee clamp comprising opposed members engaging opposed surfaces of the skier's knees, said opposed members being operable to approach one another while remaining equidistant from the determined plane.

15. The method of claim 14, wherein said step of measuring the cant angle subtended between said flat surface of said base member and said plane is performed by measuring the angle between said flat surface of said base member and means supporting said knee clamp.

* * * * *